US007840158B2

(12) United States Patent
Ohanyan

(10) Patent No.: US 7,840,158 B2
(45) Date of Patent: Nov. 23, 2010

(54) METHODS AND APPARATUS FOR REMANUFACTURING TONER CARTRIDGES

(75) Inventor: Tigran Ohanyan, Burbank, CA (US)

(73) Assignee: Mitsubishi Kagaku Imaging Corporation, San Fernando, CA (US)

( * ) Notice: Subject to any disclaimer, the term of this patent is extended or adjusted under 35 U.S.C. 154(b) by 564 days.

(21) Appl. No.: 11/985,198

(22) Filed: Nov. 13, 2007

(65) Prior Publication Data

US 2008/0112725 A1 May 15, 2008

Related U.S. Application Data

(63) Continuation-in-part of application No. 11/598,964, filed on Nov. 14, 2006, now Pat. No. 7,546,062.

(51) Int. Cl.
*G03G 15/00* (2006.01)

(52) U.S. Cl. ..... 399/109

(58) Field of Classification Search ..... 399/107, 399/109–111, 116, 117
See application file for complete search history.

(56) References Cited

U.S. PATENT DOCUMENTS

| | | | | |
|---|---|---|---|---|
| 6,735,404 | B2 * | 5/2004 | Higeta et al. | 399/109 |
| 7,346,292 | B2 | 3/2008 | Williams et al. | |
| 7,618,507 | B2 * | 11/2009 | Wazana et al. | 156/73.1 |
| 2008/0159780 | A1 | 7/2008 | Williams et al. | |

* cited by examiner

*Primary Examiner*—Hoan Tran

(57) ABSTRACT

A device for detaching a drum from a cartridge, the device having a fixture for supporting the printer cartridge; a clamp for preventing printer cartridge movement while the drum is being detached from the printer cartridge; and a cutting device having at least one adjustable cutting edge, wherein the adjustable cutting edge may be adjusted from an unexposed position to an exposed position and vice versa. A method of removing a drum from a printer cartridge, the drum being attached to the printer cartridge by at least one drum gear assembly, the drum gear assembly having a cylinder with a hollow interior, the method having the steps of supporting the printer cartridge on a fixture; substantially securing the printer cartridge; and cutting the drum gear assembly from the hollow interior.

18 Claims, 14 Drawing Sheets

METHODS AND APPARATUS FOR REMANUFACTURING TONER CARTRIDGES

CROSS REFERENCES TO RELATED APPLICATIONS

This is a continuation-in-part application of prior U.S. patent application Ser. No. 11/598,964, filed Nov. 14, 2006 now U.S. Pat. No. 7,546,062.

FIELD OF INVENTION

The present invention relates to electrophotography, particularly methods and apparatus for remanufacturing toner cartridges.

BACKGROUND

Used printer cartridges of fax machines, copiers, inkjet printers, and laser printers are often remanufactured. Generally, printers embed toner on paper by relying on electrical charges occurring within the printer cartridges. Printer cartridges typically include a toner hopper, a primary charge roller, and a drum. The toner is typically stored in the toner hopper and carries a negative charge. The drum is typically given a charge by a primary charge roller or PCR. The charge of the drum is typically more positive than the charge of the toner, and thus the drum is able to attract the toner. Once the drum is given a charge by the PCR and a print pattern is set, the drum gets coated with toner. The drum that is coated with toner then rolls over a sheet of paper, which is usually given a negative charge by the PCR. The charge of the paper is less negative than the charge of the toner, and thus the paper attracts the toner. The toner is embedded on the paper according to the print pattern.

The drum is usually one of the components that wears out from usage and gets replaced during remanufacturing. In some cartridges, such as those manufactured by Hewlett Packard company having model numbers HP 1600, HP 2600, and HP 2605, the drums are attached to the cartridges in a manner that makes the drums difficult to remove from the cartridges and may require breaking the cartridges. It is desirable to be able to detach the drums from the cartridges without having to break the parts of the cartridges. This helps preserve the appearance of the cartridges and minimizes remanufacturing steps. Methods and apparatus for efficiently and quickly detaching the drums from the cartridges are desired and are addressed by the present invention.

BRIEF DESCRIPTION OF THE PREFERRED EMBODIMENTS OF THE PRESENT INVENTION

The present invention includes a device for detaching a drum from a cartridge, the device comprising a means for supporting the printer cartridge; a means for preventing printer cartridge movement while the drum is being detached from the printer cartridge; and a cutting device comprising at least one adjustable cutting edge, wherein the adjustable cutting edge may be adjusted from an unexposed position to an exposed position and vice versa.

The present invention also includes a method of removing a drum from a printer cartridge, the drum being attached to the printer cartridge by at least one drum gear assembly, the drum gear assembly comprising a cylinder with a hollow interior, the method comprising supporting the printer cartridge on a fixture; substantially securing the printer cartridge; and cutting the drum gear assembly from the hollow interior.

The above description sets forth, rather broadly, a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways.

DESCRIPTION OF THE PREFERRED EMBODIMENTS

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. Also, it is to be understood that the phraseology and terminology employed herein are for the purpose of description and should not be regarded as limiting.

The order in which the steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the invention.

Figure 1:
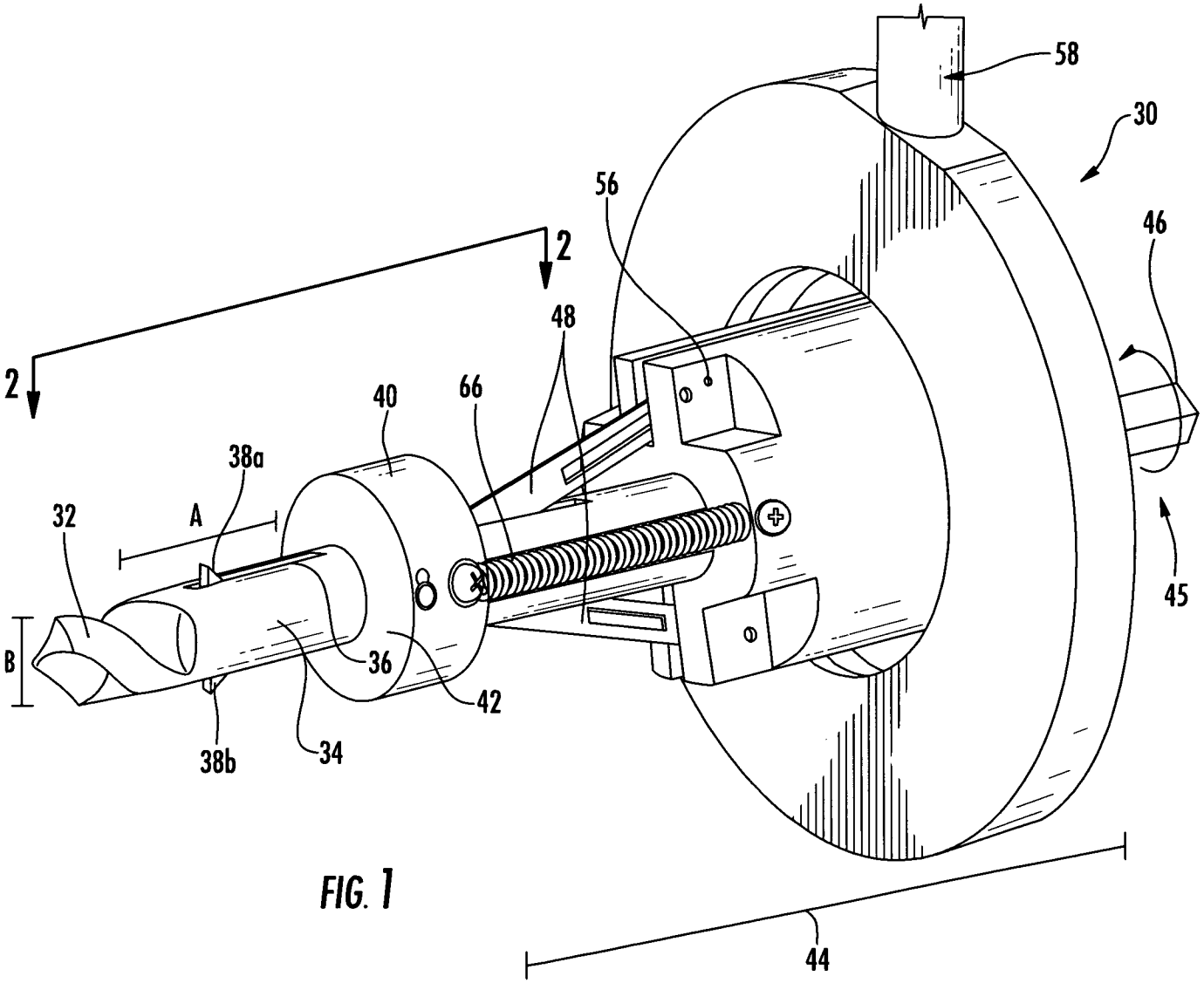
FIG. 1 is substantially a perspective view of an embodiment of a cutting tool of the present invention.

Referring to FIG. 1, the present invention includes a cutting device 30. The cutting device 30 preferably includes a drill end 32. The drill end 32 is preferably configured to be rotated to make a hole on a part of a drum gear, which is a structure that connects the drum to the printer and allows the drum to rotate when the printer is in operation (not shown). Cutting device 30 preferably also includes a drill shaft 34 extending from a non-pointed side of the drill end 32. The drill shaft 34 preferably defines a horizontal plane A and a vertical plane B. The drill shaft 34 preferably defines a recess 36 extending from side to side or laterally. The recess 36 preferably lies on the horizontal plane A. The height of the recess 36 preferably spans the entire vertical plane B of the drill shaft 34.

A pair of moveable cutting edges 38*a* and 38*b* is preferably positioned to move in and out of the recess 36. The pair of movable cutting edges 38*a* and 38*b* is preferably positioned to move in the direction that is opposite to each other's direction of movement. Each cutting edge 38 preferably includes a structure with substantially pointed edge, as shown in FIG. 1. The level of the sharpness or the dullness of the pointed edge may be varied depending on the efficiency of the cutting and the smoothness of the cut surface the user desires. The number and position of the cutting edges around the shaft may also be varied. For instance, the cutting device 30 may include only one cutting edge.

Cutting device 30 preferably further includes a stop collar 40 attached to a portion of the drill shaft 34 where the recess 36 runs. The stop collar 40 preferably surrounds the outer surface of the drill shaft 34 and covers a portion of the recess 36. The stop collar 40 preferably rotates with the drill shaft 34. The stop collar 40 is shown to be circular in shape in FIG. 1. However, the stop collar 40 may be designed with various shapes.

The position of the stop collar 40 on the drill shaft 34 is preferably adjacent to the cutting edges 38*a* and 38*b* and in between an actuating mechanism 44 and the cutting edges 38*a* and 38*b*. The stop collar 40 preferably includes a stop surface 42, which is preferably substantially flat and configured to abut a part of the cartridge (not shown). The distance between the cutting edges 38*a* and 38*b* and the stop collar 40 is preferably predetermined depending on where on the drum or the drum gear the cutting device is designed to make the cut. Once the location of the cut is determined, the distance between the location of the cut and the part of the cartridge to which the stop surface 42 will abut can be calculated. The calculated distance may be used in positioning the stop collar 40 on the drill shaft 34. That is, the calculated distance may be used as the distance between the cutting edges 38*a* and 38*b* and the position of the stop surface 42 on the drill shaft 34. It can be realized that the cutting device 30 of the present invention provides a way to cut in a manner where the location of the cut may be adjusted and may be determined with precision.

The drill shaft 34 and the recess 36 therein preferably extend sideways past the location of the stop collar 40. Substantially adjacent to the stop collar 40 and substantially opposite the drill end 32 on the drill shaft 34 is preferably an actuating mechanism 44 for the cutting edges 38*a* and 38*b*, which is discussed further below. The drill shaft 34 preferably includes an end 45 opposite the drill end 32, which preferably includes a drill attachment tip 46 attached thereto. The drill attachment tip 46 preferably includes a non-circular periphery such that an electric drill (not shown) may easily grasp the tip 46 and electrically rotate the drill shaft 34.

Figure 2:
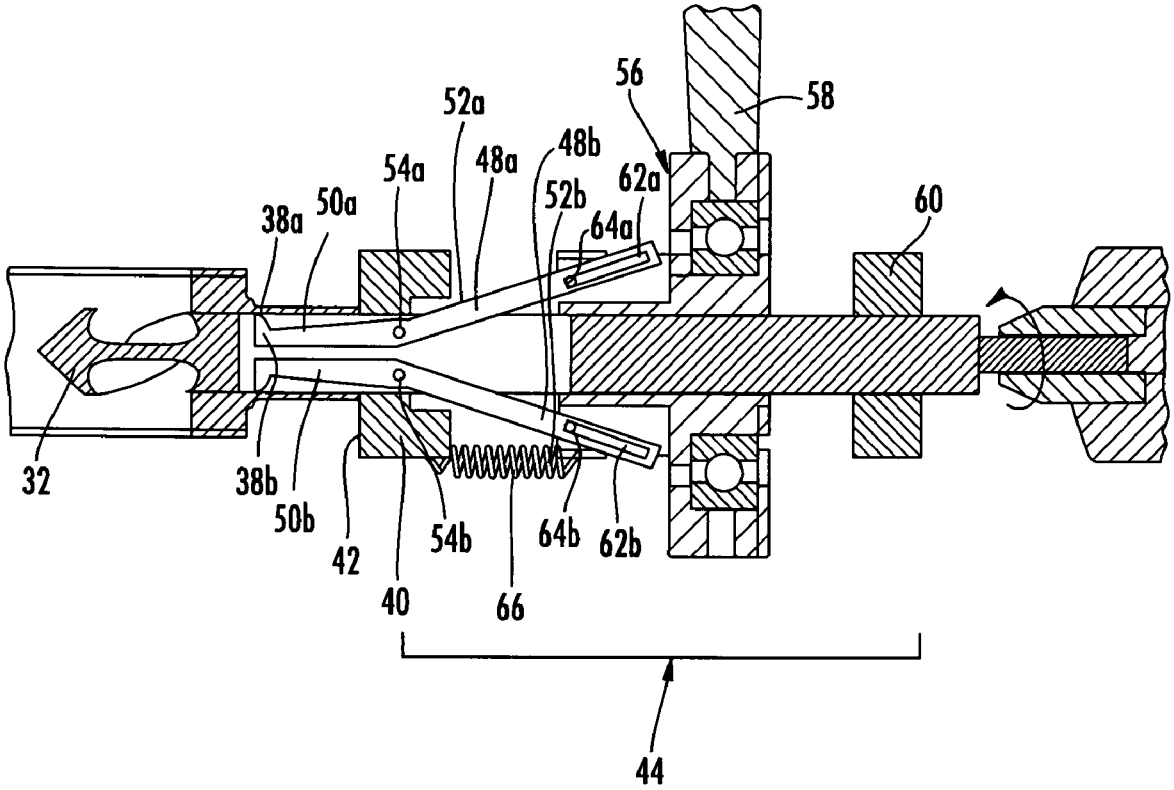
FIG. 2 is substantially a cross-sectional view of the cutting tool shown in FIG. 1.

With reference now to FIG. 2, the actuating mechanism 44 for the cutting edges 38*a* and 38*b* is shown and preferably includes cutter arms 48*a* and 48*b*, arm actuation device 56, actuation device handle 58, and actuation device stop collar 60. Each cutting edge 38*a* and 38*b* is preferably integral to or a part of a corresponding cutter arm 48*a* and 48*b*. Each cutter arm 48 preferably includes a first component 50*a* or 50*b*, which is preferably positioned within the confines of the drill shaft 34.

First components 50*a* and 50*b* preferably extend to their respective second components 52*a* or 52*b*, which are preferably positioned at an angle relative to the first components 50*a* and 50*b*. In the preferred embodiment, the second component 52 is preferably at an angle between 90-180 degrees from the first component 50. Substantial portions of the second components 52 preferably project out of the confines of the drill shaft 34 through the recess 36. Each cutter arm 48 is preferably attached to the drill shaft 34 via a mechanical pin 54*a* or 54*b* positioned within the confines of the recess 36 and attached to the interior wall of the drill shaft 34. Each cutter arm 48 may preferably pivot around its respective mechanical pin 54.

With continued reference to FIG. 2, each second component 52 of the cutter arm 48 is preferably moveably attached to the arm actuating device 56 from an end that is distal and opposite from the cutting edges 38. Each of said second component end preferably defines a lateral recess 62*a* and 62*b* extending from side to side. The arm actuating device 56 preferably attaches to each second component via a mechanical pin 64*a* or 64*b* that passes through the recess 62*a* or 62*b* and that is attached to the arm actuating device 56. The mechanical pin 64 is preferably configured to slide within the recess 62 when the actuating device 56 is operated to activate the cutting edges 38.

The actuating device 56 is preferably a structure that defines a cylindrical recess configured to accommodate the drill shaft 34. The drill shaft 34 is preferably inserted through this cylindrical recess to allow the actuating device 56 to slide sideways on the drill shaft 34. The actuating device may be made with various shapes. The actuating device 56 is preferably attached to one end of a biasing device 66. The other end of the biasing device 66 is preferably attached to the stop collar 40. It can be realized from FIG. 2 that the actuating device 56 is preferably biased to move toward the stop collar 40 in the deactivated position. In the deactivated position, the biasing device 66 also positions the actuating device 56 and the mechanical pin 64 toward the stop collar 40. First component 50*a* is preferably biased to pivot counterclockwise. First component 50*b* is preferably biased to pivot clockwise. In other words, in the deactivated position, cutter arms 48*a* and 48*b* are biased to pivot toward each other. As a result, the cutting edges 38*a* and 38 are preferably positioned to be contained inside the confines of the drill shaft 34 when the actuating device 56 is deactivated.

With continued reference to FIG. 2, an actuation device stop collar 60 that wraps around and is attached to the drill shaft 34 may be provided to limit the sliding distance of the actuating device 56. The actuating device 56, the stop collar 60, and the stop collar 40 preferably wrap around the drill shaft 34 rotates with the drill shaft 34. The actuation device stop collar 60 is preferably positioned on the drill shaft 34 at a predetermined distance relative to the actuating device 56. The predetermined distance is preferably based on the desired maximum height of the cutting edge 38 when the cutting device 30 will be operated. The height of the cutting edge 38 that will project out of the recess 36 is directly proportional to the distance between the actuation device stop collar 60 and the actuating device 56. It can be realized that the height of the cutting edge 38 from the drill shaft 34 determines the depth of the cut created by the cutting edge 38.

Figure 3:
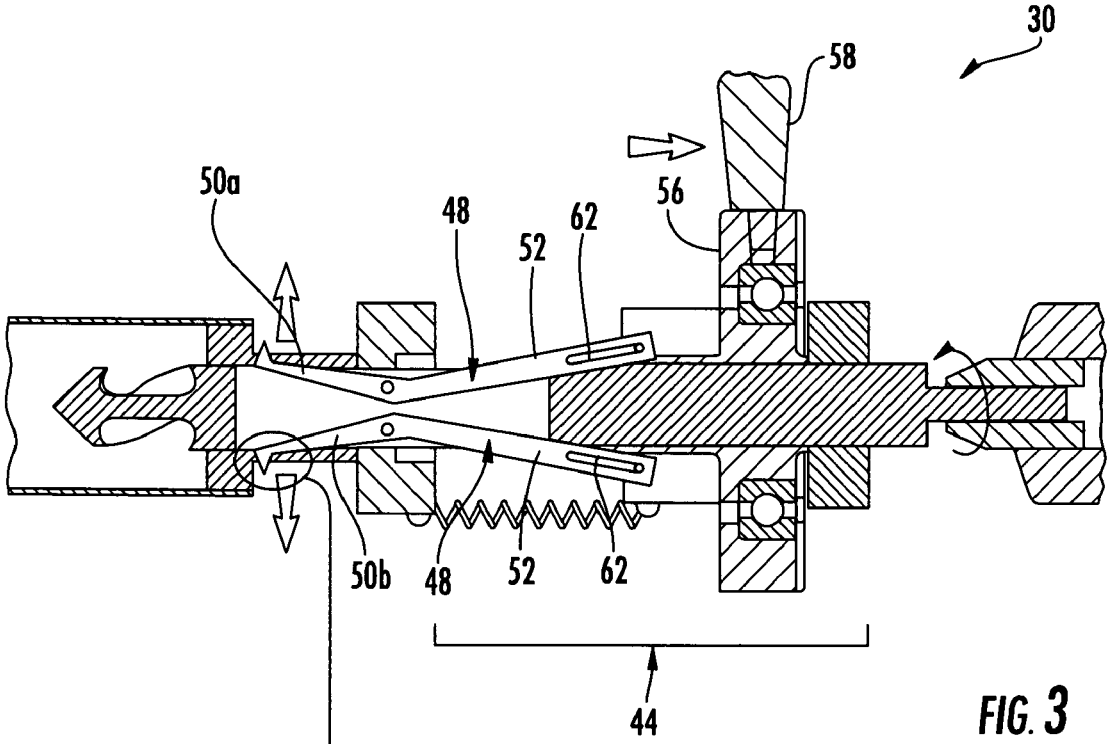
FIG. 3 is substantially a cross-sectional view of the cutting tool shown in FIG. 1, the cutting edges being shown to be actuated.

Referring now to FIG. 3, the actuating mechanism 44 may be activated as follows. A user may hold a handle 58 attached to the actuating device 56 and pull said handle 58 towards the stop collar 60 as indicated by the arrow. The handle 58 preferably includes an elongate body and a circular body attached thereto, which is preferably configured to surround the actuating device 56. The periphery of the actuating device 56 is preferably attached to the circular body, such that when the handle 58 is pulled, the actuating device 56 is carried by the circular body while, at the same time, when the shaft 34 is rotated, the actuating device 56 rotates with the shaft 34 around the circular body of the handle 58.

Figure 4:
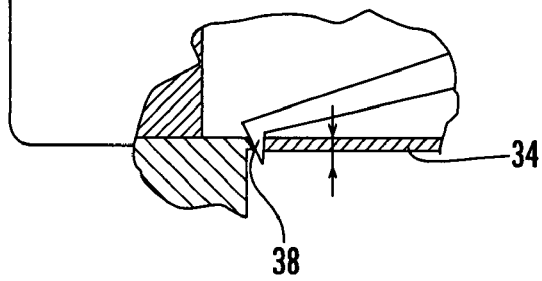
FIG. 4 is substantially a cut-away and close up view showing the activation of the cutting edges.

Thus, when the handle 58 is pulled towards the stop collar 60, the actuating device 56 moves along with the handle 58, the biasing device 66 is stretched, and the mechanical pin 64 contained in the recess 62 defined by the cutter arm 48 is moved toward the actuating device 56. The cutter arm 48 preferably pivots around mechanical pin 54 and causes first component 50*a* to pivot clockwise and first component 50*b* to pivot counterclockwise. The result is that when the actuating mechanism is activated, cutting edges 38*a* and 38*b* are caused to pass through the recess 36 and project out of the drill shaft 34, as indicated by the arrow and as shown in FIG. 4. It can be realized that the cutting edges 38*a* and 38*b* are now in a position to contact the objects introduced to them. An electric drill may be used to rotate the drill shaft 34 and the cutting edges 38*a* and 38*b* to cut an object. For instance, the cutting edges 38*a* and 38*b* may be used to cut a portion of a drum gear that holds the drum to a cartridge thereby allowing the removal of the drum from the cartridge (FIGS. 8 and 9).

Figure 5:
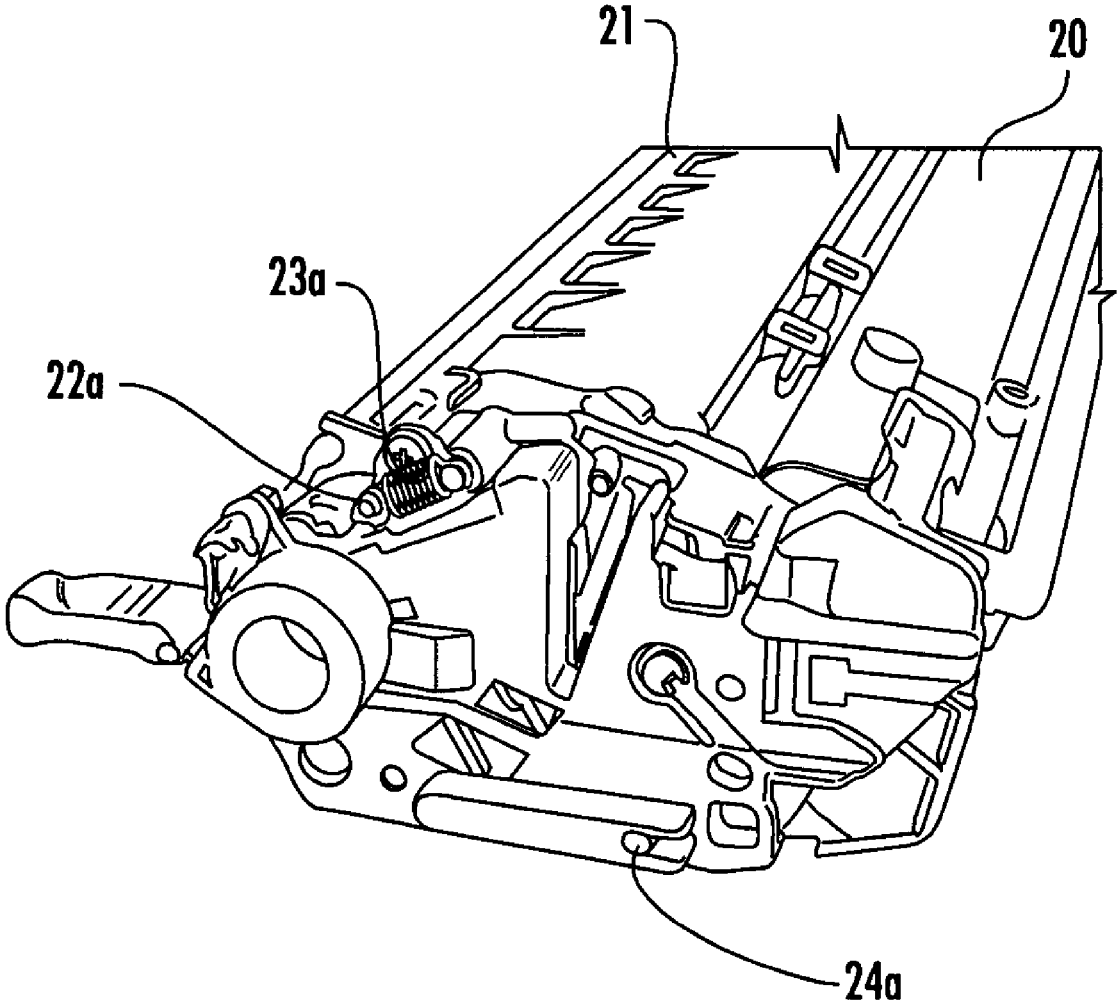
FIG. 5 is substantially a side perspective view of a print toner cartridge for which the cutting tool of the present invention may be used.
Figure 6:
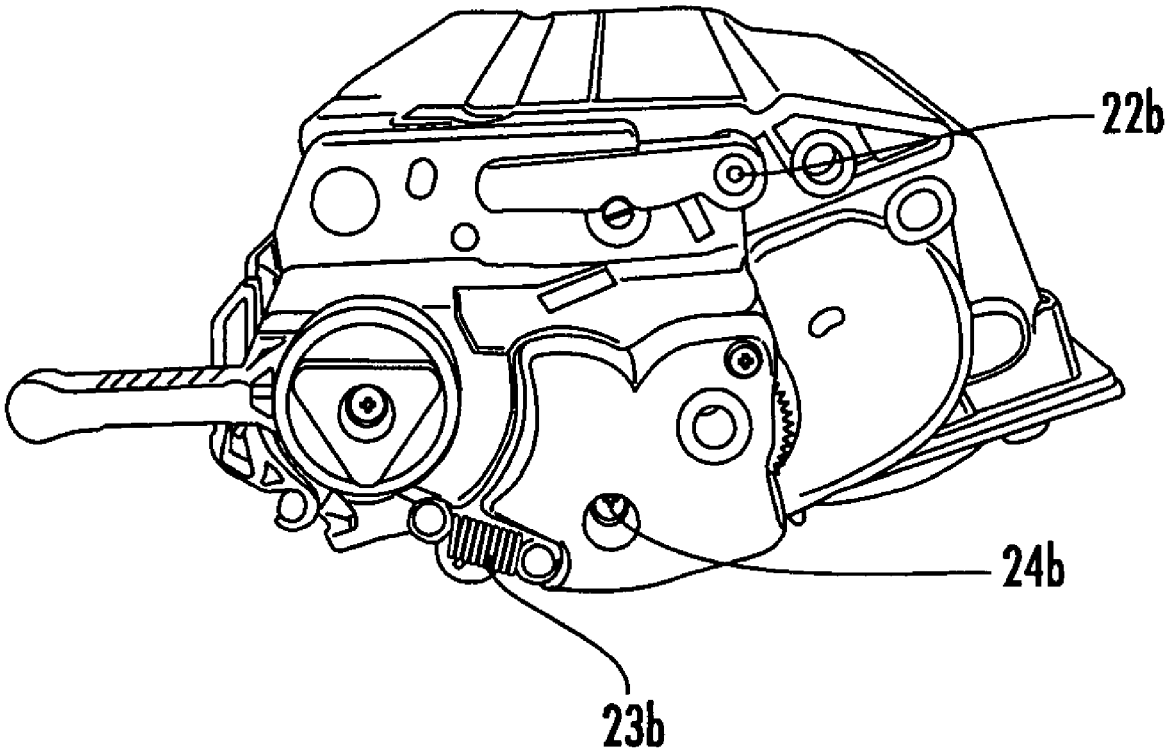
FIG. 6 is substantially another side view of the print toner cartridge shown in FIG. 5.
Figure 7:
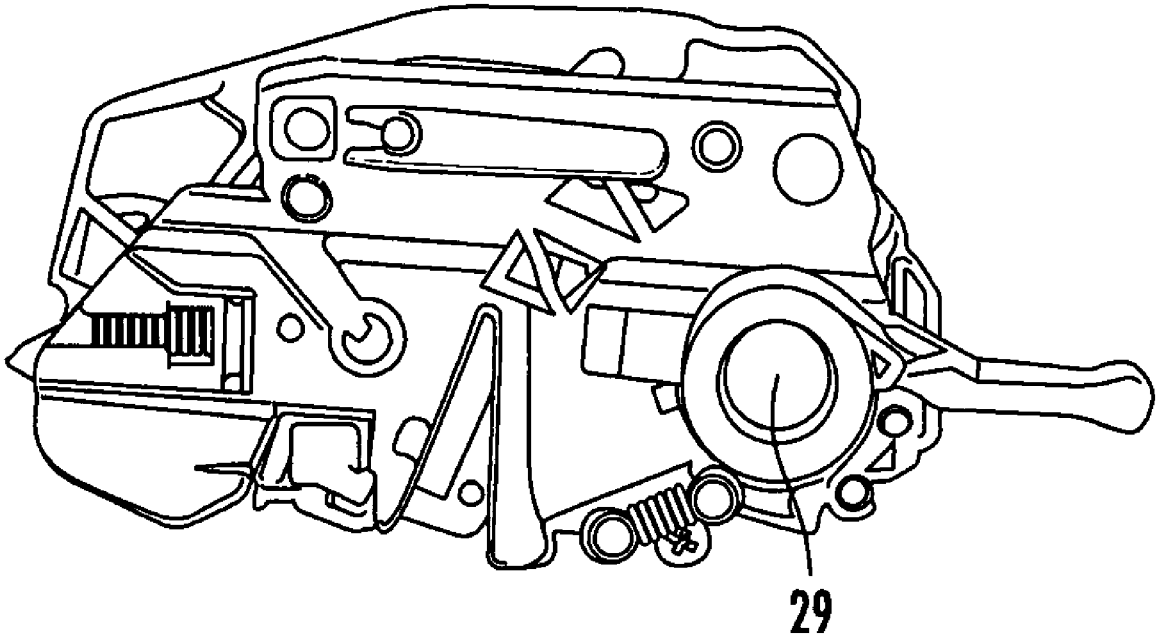
FIG. 7 is substantially another side view of the print toner cartridge shown in FIG. 5 showing a perpendicular wall within a drum gear.

In addition to the various embodiments of the cutting tool 30, the present invention also includes methods of remanufacturing a toner cartridge, which will now be discussed. In the discussion below, laser printer cartridges from Hewlett Packard company having model numbers HP 1600, HP 2600, and HP 2605 are used as examples for ease of description. The methods are by no means limited to the remanufacturing of laser printer cartridges from Hewlett Packard company. The methods may be executed in remanufacturing of cartridges of various types of printers from various companies. As shown in FIGS. 5 and 6, a used toner cartridge typically includes a toner hopper 20, which is usually refilled with toner during remanufacturing and a waste hopper 21, which may be cleaned during remanufacturing. The drum of the used toner cartridge may also need to be replaced. To access the drum, the toner hopper 20 and the waste hopper 21 are preferably separated by detaching the screws 22*a* and 22*b*, springs 23*a* and 23*b*, and pins 24*a* and 24*b*.

In FIGS. 7-11, a typical toner cartridge drum 26 includes a cylindrical body 25 with hollow interior (not shown). The drum typically includes a drum gear 27 configured to be connected to the printer (not shown) and allow the drum the rotate when the printer is in operation. The drum gear may have a cylindrical body 28 and are attached to both ends of the drum body 25. Some drum gears include a gear wall 29 (FIG. 7) positioned perpendicular to the cylindrical body of the drum gear. It can be realized that when the drum gear is attached to the drum and the drum is attached to the cartridge, the gear wall 29 may serve to block access to the hollow interior of the cylindrical drum body. The gear wall 29 may also block access to a gear portion in between the gear wall and the drum.

Figure 8:
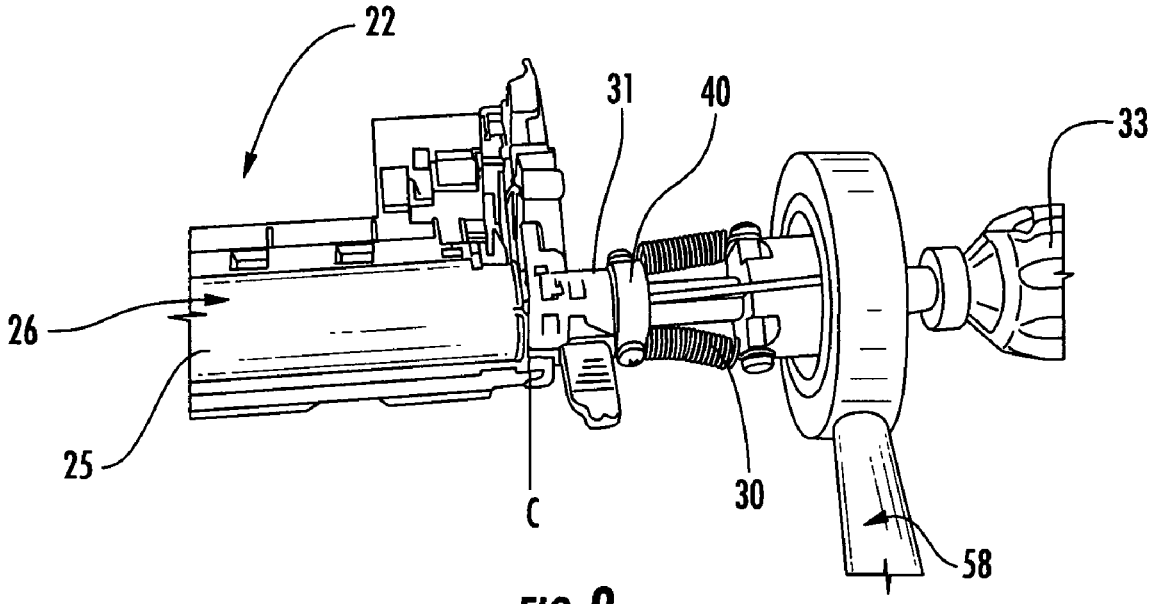
FIG. 8 is substantially a front view of the cutting tool of the present invention being used to remove a drum from the waste hopper.
Figure 9:
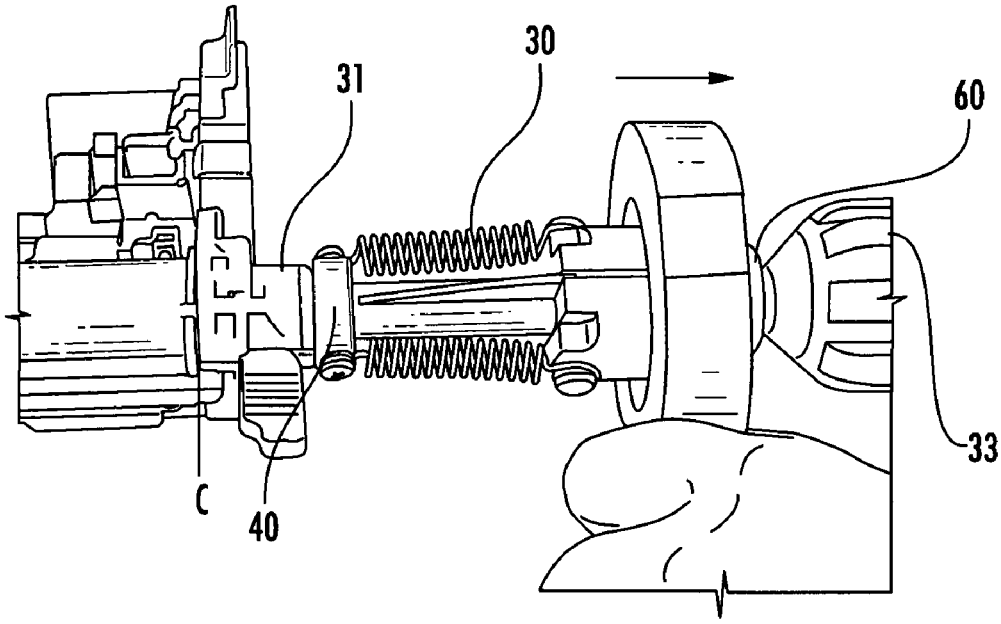
FIG. 9 is substantially a front view of the cutting tool of the present invention being used to remove the drum.

Referring now to FIG. 8, once the toner hopper and the waste hopper are separated, the cutting tool 30 may be used to remove the drum 26 from the cartridge 31. The cutting tool 30 is preferably attached to an electric drill 33. The electric drill 33 preferably allows the drill end 32 of the cutting tool to puncture and enter through the gear wall 29. Once drill end 32 enters through the gear wall 29, the drill shaft 34 also enters through the gear wall and in the hollow interiors of the cylindrical bodies of the gear and the drum. It can be realized that if the drum gear does not have a gear wall, an embodiment of the cutting tool need not include a drill end 32 attached to the drill shaft 34.

Figure 11:
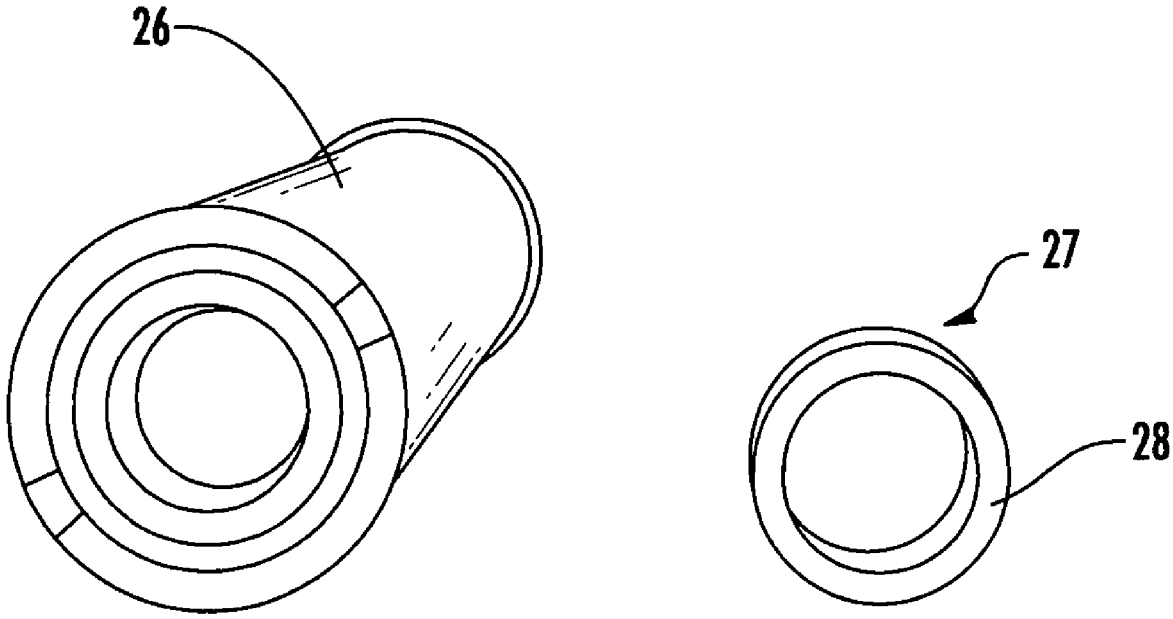
FIG. 11 is substantially a side view of the drum and the drum gear cut apart by the cutting tool of the present invention.

Referring now to FIG. 9, once the drill shaft 34 is inserted through the hollow interior of the drum gear, the stop collar 40 preferably abuts the cartridge portion 31 to prevent further forward motion of the drill end and shaft. The user may activate the actuating mechanism 44 by pulling the handle 30 towards the electric drill 33 while keeping the stop collar 40 abutted to the cartridge portion 31. The user may continue pulling of the handle in the direction indicated preferably until the actuating device 56 abuts the stop collar 60. As the user pulls the handle in the direction indicated, the cutter arm 48*a* preferably pivots clockwise and cutter arm 48*b* preferably pivots counterclockwise (not shown in FIG. 9). The result is that the cutting edges 38*a* and 38*b* are caused to pass through the recess 36 and project out of the drill shaft 34 (not shown in FIG. 9). The cutting edges 38*a* and 38*b* consequently contact the interior wall of the cylindrical body of the drum gear 27. The electric drill preferably rotates the cutting edges 38*a* and 38*b*, which eventually cuts the drum gear 27 at the area indicated by arrow C. The area indicated by arrow C is preferably a gear portion in between the drum body 26 and the cartridge 31. The cut made by the cutting edges 38*a* and 38*b* are preferably around the circumference or the periphery of a gear portion (as shown in FIG. 11).

Figure 10:
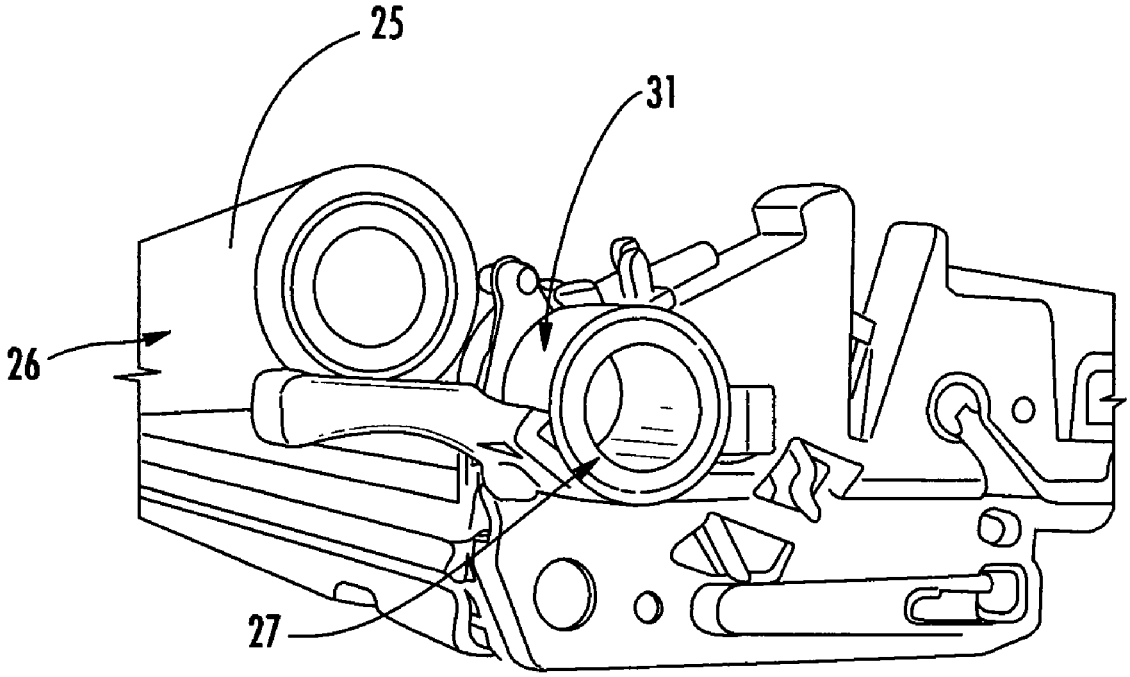
FIG. 10 is substantially a perspective view of the drum substantially detached from the cartridge by the cutting tool of the present invention.

It can be appreciated that, with the present invention, the precision of the location of the area where the cutting edges 38 and 38*b* will make a cut can be attained by adjusting the distance between of the stop collar 40 relative to the cutting edges 38*a* and 38*b*. Referring now to FIGS. 10 and 11, the drum 26 may now be detached from the cartridge 31. It can be appreciated from FIG. 10 that the cutting device 30 of the present invention is able to cut the gear 27 of the drum from the hollow interior of the cylindrical body 28 of the gear and cleanly cut the periphery of the cylindrical body 28 of the drum gear 27 (FIGS. 10 and 11).

Figure 12:
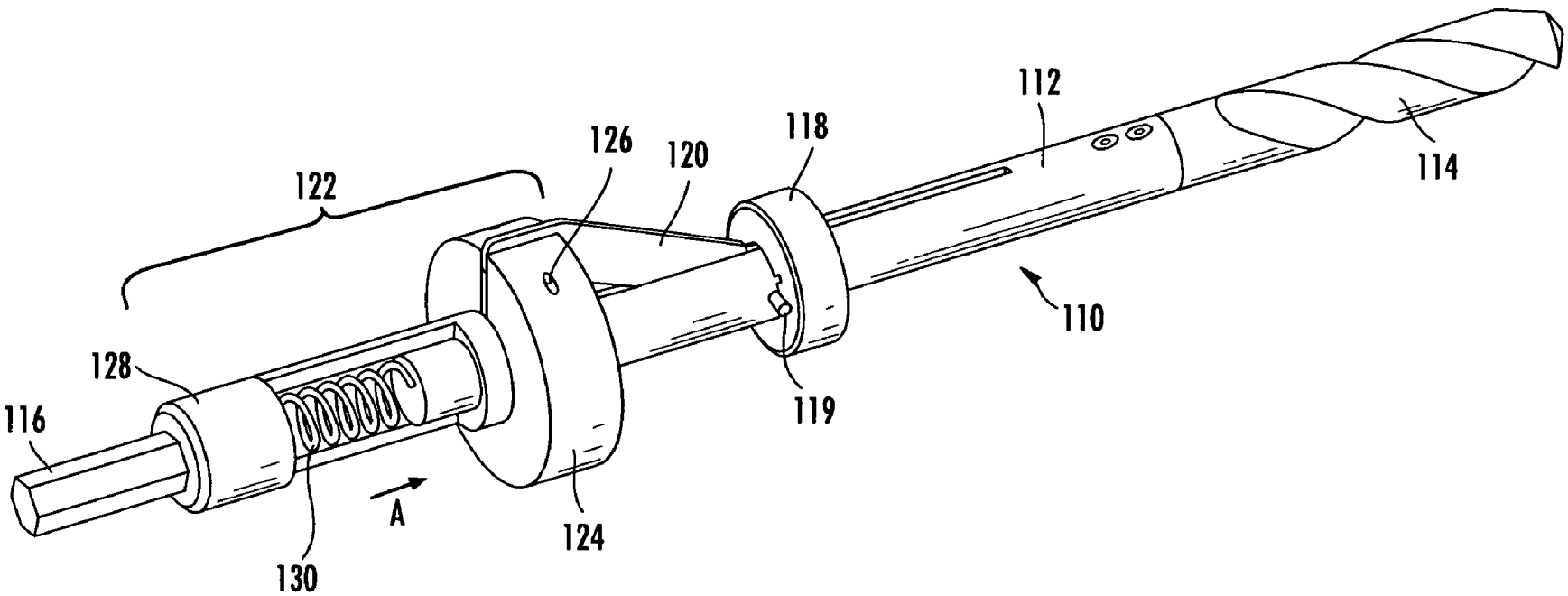
FIG. 12 is substantially a perspective view of another cutting tool embodiment.

Another embodiment 110 of the cutting device of the present invention is shown in FIG. 12. Like the cutting device 30, cutting device embodiment 110 preferably includes a drill shaft 112 with a drill end 114 attached to one of its end. The drill end 114 is preferably configured to allow the cutting device to penetrate through the gear wall (FIG. 7) and the cutting edge of the cutting device to be positioned proximate to the cutting area (FIGS. 8 and 9). Cutting device embodiment 110 preferably also includes a stop collar 118, which aids in controlling the penetration of the drill shaft 112 through the gear wall so that the cutting edge of the cutting device may be precisely positioned proximate to the cutting area. The stop collar 18 may surround the drill shaft 112 at a predetermined location and may be held in place by its tight fit around the drill shaft 112 and by a placement pin 119.

Cutting device embodiment 110 preferably differs from the cutting device 30 in the number of cutting arms and edges. Cutting device embodiment 110 preferably includes a single cutting arm 120 and a cutting edge (not shown in FIG. 12), while cutting device 30 includes two cutting arms with two cutting edges. Cutting device embodiment 110 may also differ from the cutting device 30 in terms of its actuating mechanism 122 for moving the cutting arm and cutting edge.

Actuating mechanism 122 of the cutting device embodiment 110 preferably includes a collar 124 that surrounds the drill shaft 112. One end of the cutting arm 120 is preferably attached to the collar 124 of the actuating mechanism 122 via a pin 126. The pin 126 preferably passes through the collar 124 and the cutting arm 120. Part of the cutting arm 120 is preferably positioned inside the drill shaft 112. The end of the cutting arm 120 that is opposite to the end attached to the collar 124 preferably defines the cutting edge (not shown in FIG. 12).

With continued reference to FIG. 12, the cutting device embodiment 110 preferably includes a second shaft 128 to which the drill shaft 112 is slidably attached. A biasing device 130, such as a spring, is preferably attached to the drill shaft end 112 within the second shaft 128. The biasing device 130 is preferably biased to move the drill shaft 112 to the direction A as shown in FIG. 12.

Figure 13:
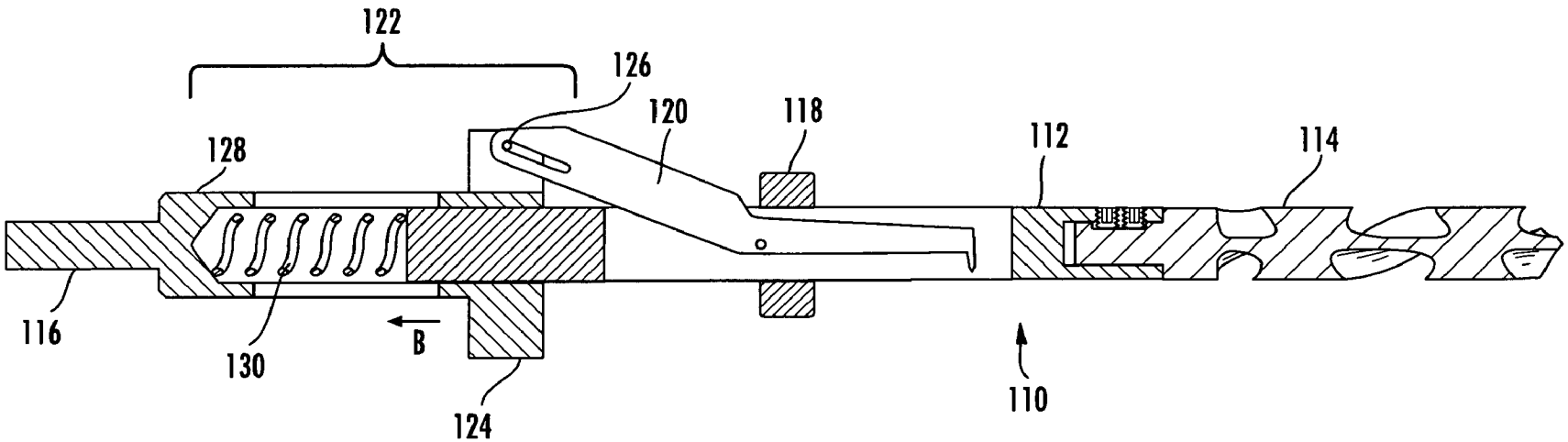
FIG. 13 is substantially a cross-section view of the cutting tool embodiment of FIG. 12 with its cutting edge deactivated.

Referring now to FIG. 13, to use the cutting device embodiment 110, the drill end 114 is preferably drilled through the gear wall of the printer cartridge (not shown) and the drill shaft 112 is preferably inserted through the printer cartridge until the stop collar 118 abuts the printer cartridge. Pressure may be applied to the stop collar 118 by pushing it with the drill shaft 112 towards the printer cartridge. As the stop collar 118 and the drill shaft 112 are pushed towards the printer cartridge, drill shaft 112 preferably slides through second shaft 128 in the direction B pushing the biasing device 130.

Figure 14:
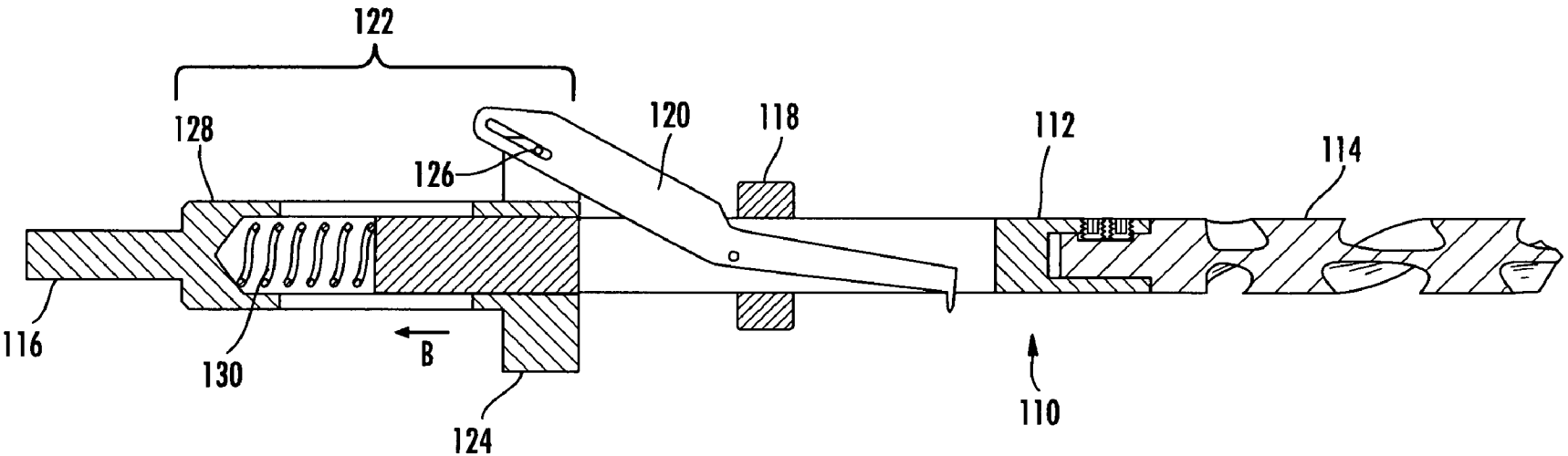
FIG. 14 is substantially a cross-section view of the cutting tool embodiment of FIG. 12 with its cutting edge activated.

Referring to FIG. 14, as the drill shaft 112 slides through second shaft 128 in the direction B, one end of the cutting arm 120 preferably moves past the pin 126, which then allows the cutting arm to partially rotate clockwise and move its cutting edge 132 out of the confines of the drill shaft 112. The cutting edge 132 is now in a cutting position. An electric drill (not shown) may be used to rotate the cutting edge 132, which may contact and cut the drum gear or a drum portion from their hollow interior. After the drum gear is cut, pressure may be relieved off the stop collar 118, which allows the biasing device to push the drill shaft 112 opposite direction B and the cutting arm 120 to its previous position shown in FIG. 13.

Figure 15:
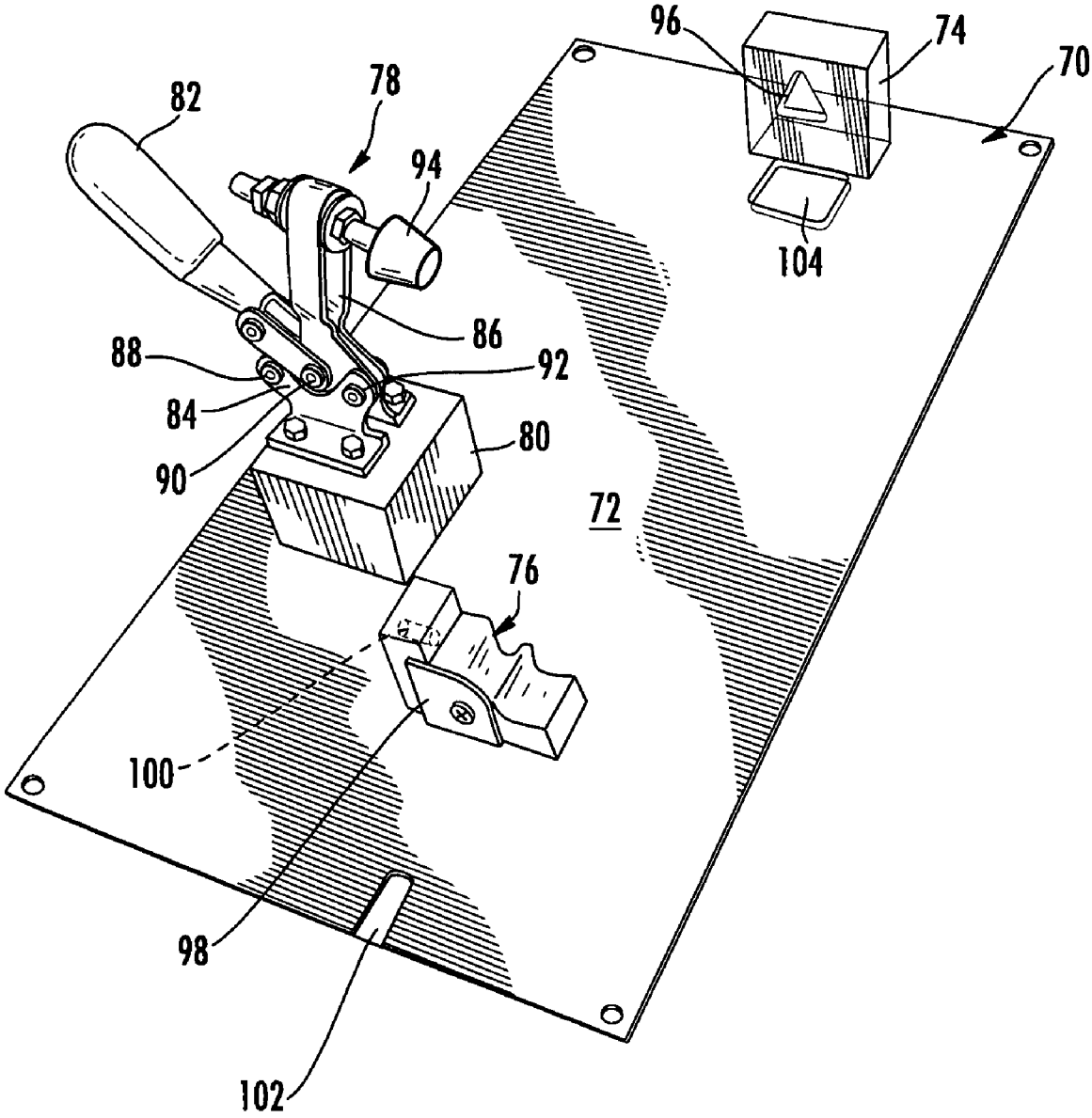
FIG. 15 is substantially a perspective view of a fixture that may be used with the cutting tool of the present invention.

Referring now to FIG. 15, a fixture 70 may be used with the cutting device 30 of the present invention. The fixture 70 is preferably configured to hold the printer cartridge 31 so that movements of the printer cartridge 31 can substantially be prevented when the cutting device 30 is being used to cut the drum gear 27 and detach the drum 26 from the printer cartridge 31. The fixture 70 preferably includes a base 72, a first mount 74 attached to the base 72, and a second mount 76 attached to the base and positioned at the end of the base that is opposite to the end of the base where the first mount 74 is attached.

The first mount 74 preferably defines a drum gear receiver 96, which may be formed from the first mount 74 as a depression and may be shaped depending on the shape of the drum gear end 98 it is intended to accommodate, such as a triangular shape (FIG. 6). The edges of the depression may be designed to substantially prevent rotating movement of the drum gear that is positioned within the drum gear receiver 96 and consequently the drum 26.

The second mount 76 is preferably shaped to provide a surface to support the cartridge 31. The second mount 76 may include a cartridge stop 98, which preferably protrudes from the supporting surface of the second mount. The cartridge stop 98 is preferably sized to fit through the area in between the drum gear and the drum, as pointed with the arrow C on FIGS. 8 and 9. It can be appreciated that when the cartridge stop 98 fits through area C, the cartridge stop 98 is able to substantially prevent horizontal movements of the cartridge 31. It can further be appreciated that the cartridge stop 98 may also function to protect cartridge portions from getting damaged by the cutting tool, such as the cartridge handle and end cap, as the cartridge stop 98 preferably moves these cartridge portions away from the cutting area.

The second mount 76 may also define a drill passage 100 so that a drill may be inserted through the passage 100 and through the drum to hold the drum when detaching the drum from the cartridge using the cutting device 30. The drum and the drum gear may have a tendency to rotate with the cutting tool, which prevents the cutting tool from cutting the drum gear effectively. By drilling through the drum with the drill, the rotational movement of the drum and the drum gear may be prevented during the cutting process. It is noted that the drill may not have to be drilled through the drum. The drill may be able to prevent the drum and the drum gear from rotating by just being in contact with the drum and applying adequate pressure on the drum. It is further noted that materials other than a drill may be inserted through the drill passage to apply pressure on the drum thereby minimizing drum movement during the cutting process, such as a sturdy stick or a rod.

The base 72 may further include depressions 102 and 104 designed to further hold the cartridge during the drum detachment with the cutting device 30. Depression 102 may be positioned substantially adjacent to second mount 76, and depression 104 may be positioned substantially adjacent to first mount 74. Depressions 102 and 104 may be designed to substantially prevent rotating movements of the cartridge 31 by accommodating cartridge handles attached to the endplates of cartridge 31.

The fixture 70 preferably also includes a clamp 78 that is mounted on a clamp mount 80, which is attached to the base 72. The clamp 78 preferably includes a clamp handle 82 that preferably pivots around a clamp base 84. The clamp 78 preferably also includes a clamp arm 86 that is connected to the clamp handle 82 and the clamp base 84. The handle 82 may be moved from a deactivated position where the handle 82 causes the clamp arm 86 to be positioned away from the base 72 to an activated position where the handle 82 causes the clamp arm 86 to move towards the base 72. As the handle 82 is moved from the deactivated position to the activated position, the handle 82 preferably pivots around the clamp base 84 at pivot point 88 and the clamp arm 86 at pivot point 90. The clamp arm 86 preferably also pivots around clamp base 84 at pivot point 92 and the handle 82 at pivot point 90. The clamp arm 86 preferably includes a drum press 94 attached substantially perpendicular to it. As the handle is moved from the deactivated position to the activated position, the drum press 94 is preferably moved to contact the drum positioned on the fixture 72. The drum press 94 may be made of substantially sticky and soft material, such as rubber, so that it may be effective in substantially preventing movements of the drum 26 when positioned on the fixture 70.

Figure 16:
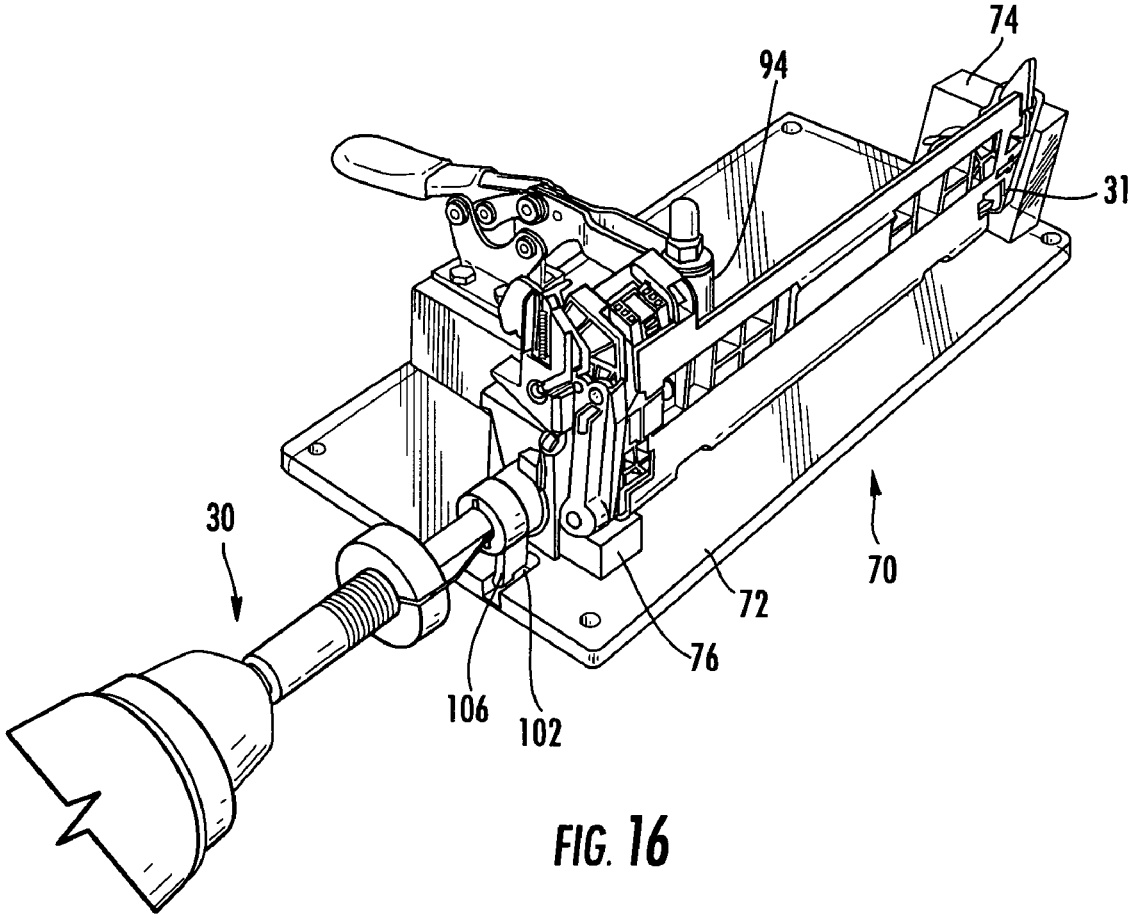
FIG. 16 is substantially a perspective view of the cutting tool of the present invention being used with the fixture of FIG. 14.

Referring now to FIG. 16, a cartridge portion 31 may be positioned on the fixture such that one of its ends is supported by the second mount 76 and another end is supported by the first mount 74. The clamp 78 may be moved to an activated position wherein the drum press 94 is contacts the drum. The cartridge handle 106 can be seen as being positioned within depression 102 of the base 72 thereby allowing the fixture 70 to further hold the cartridge 31 while the cutting device 30 is used to cut and detach the drum from the cartridge 31.

It can now be realized that the present invention facilitates the removal of the drum with little or no requirement of having to break any portion of the cartridge 31. This advantage is highly beneficial in the remanufacturing of cartridges, as the appearance of the cartridge is preserved. Additionally, since the removal of the drum by the present invention reduces or avoids having to break any portion of cartridges, the present invention avoids extraneous steps of having to put back broken cartridges. It can further be realized that the present invention provides a new cutting tool and technique for cutting hollow objects from its hollow interior. It can also be realized that the present invention provides a new technique for efficiently removing and replacing a toner cartridge drum, which may be practiced when remanufacturing a previously used toner cartridge.

Although the description above contains many specifications, these should not be construed as limiting the scope of the invention but as merely providing illustrations of some of the presently preferred embodiments of this invention. For example, various mechanical fasteners known in the art may be used in lieu of the mechanical pins described herein. The cutting device may be used for cutting hollow objects from the hollow interior side of the objects other than toner cartridge drums. The shapes of the stop collars and the actuating device may be varied. The shapes and number of cutting edges and cutter arms may be varied. The invention is capable of other embodiments and of being practiced and carried out in various ways. The invention is not limited in its application to the details of the construction and to the arrangement of the components set forth in the above description or as illustrated in the drawings.

What is claimed is:

1. A method of detaching a drum from a printer cartridge, the drum being attached to the printer cartridge with a drum gear assembly, the printer cartridge comprising at least one end cap positioned on one side of the printer cartridge, the method comprising:

a. supporting the printer cartridge with a fixture, wherein the fixture comprises a cartridge stop, the cartridge stop being configured to be inserted in between the drum and the end cap;

b. substantially preventing cartridge movement by engaging a portion of the cartridge to the fixture;

c. providing a cutting device;

d. penetrating the cutting device through the end cap of the printer cartridge; and e. cutting the drum gear assembly with the cutting device.

2. The method of claim 1, further comprising pressing the printer cartridge against the fixture.

3. The method of claim 1, further comprising substantially preventing the drum from rotating.

4. The method of claim 3, wherein the fixture comprises a base, the base defining a depression, the depression being configured to accommodate a cartridge handle to substantially prevent cartridge movement.

5. The method of claim 1, wherein the fixture comprises at least one mount, the mount defining a drum gear receiver, the drum gear receiver being configured to receive a portion of a drum gear of the printer cartridge and allow the drum gear to be engaged with the drum gear receiver.

6. The method of claim 1, wherein the fixture comprises at least one mount, the mount configured to support the printer cartridge, and further comprising allowing a drill to penetrate through the mount and contact the drum to substantially prevent drum movement.

7. A device for detaching a drum from a printer cartridge, the device comprising:

a. a means for supporting the printer cartridge;

b. a means for preventing printer cartridge movement while the drum is being detached from the printer cartridge; and c. a cutting device comprising at least one adjustable cutting edge, wherein the adjustable cutting edge may be adjusted from an unexposed position to an exposed position and vice versa.

8. The device of claim 7, further comprising a means for drilling through a cartridge end cap, the means for drilling being attachable to the cutting device.

9. The device of claim 7, wherein the cutting device further comprises a position means for adjusting the position of the cutting edge relative to a cutting surface.

10. The device of claim 7, further comprising a means for rotating the cutting edge.

11. A method of removing a drum from a printer cartridge, the drum being attached to the printer cartridge by at least one drum gear assembly, the drum gear assembly comprising a cylinder with a hollow interior, the method comprising:

a. supporting the printer cartridge on a fixture;

b. substantially securing the printer cartridge;

c. cutting the drum gear assembly from the hollow interior; and, d. pressing on the drum.

12. The method of claim 11, further comprising engaging a printer cartridge portion with the fixture.

13. The method of claim 11, further comprising pressing a printer cartridge portion against the fixture with a clamp.

14. The method of claim 11, further comprising engaging the drum gear assembly to a fixture mount, the fixture mount being attached to the fixture.

15. The method of claim 11, further comprising providing a cutting tool, the cutting tool being configured to rotate within the hollow interior, and drilling through the drum gear assembly to introduce the cutting tool in the hollow interior.

16. The method of claim 11, further comprising providing an electric drill and activating the electric drill to cut the drum gear assembly.

17. The method of claim 11, further comprising providing a cutting tool, the cutting tool comprising at least one adjustable edge, the adjustable edge being movable from an unexposed position to an exposed position.

18. The method of claim 11, further comprising cutting the drum gear assembly with a circular pattern.

* * * * *